United States Patent [19]

Hartman et al.

[11] Patent Number: 4,615,362

[45] Date of Patent: Oct. 7, 1986

[54] OVERFILL AND SPILLAGE PROTECTION DEVICE

[75] Inventors: Harry B. Hartman, Sugar Grove, Ill.; Gerard V. LaLonde, Durham, N.C.; Michael S. Butkovich, Aurora, Ill.

[73] Assignee: Standard Oil Company (Indiana), Chicago, Ill.

[21] Appl. No.: 727,275

[22] Filed: Apr. 25, 1985

[51] Int. Cl.[4] ..... B65B 3/06

[52] U.S. Cl. ..... 141/86; 141/98; 141/286; 52/20; 138/89

[58] Field of Search ..... 141/285–310, 141/37–66, 86, 115, 199–205, 98, 392; 137/312–314, 364, 341; 285/42, 43, 44, 192, 205; 138/89; 4/286, 293, 295; 52/19, 20, 21; 277/212 FB, 189

[56] References Cited

U.S. PATENT DOCUMENTS 4,278,115 7/1981 Briles et al. ..... 141/86

FOREIGN PATENT DOCUMENTS 1140418 11/1962 Fed. Rep. of Germany ..... 141/199

*Primary Examiner*—Houston S. Bell, Jr.

*Attorney, Agent, or Firm*—Thomas W. Tolpin; William T. McClain; William H. Magidson

[57] ABSTRACT

An environmentally safe protection device is provided to contain and store both fill hose spillage and underground tank overfill of gasoline and diesel fuel. The containment and protection device has a fill tube and an auxiliary vapor return tube to accommodate Stage I Vapor Recovery. The containment device also has a reservoir to contain overfill from the underground tank and spillage from the fill hose. A special valve assembly automatically drains motor fuel from the reservoir into the underground tank when the tank is at least partially empty and prevents upward passage of motor fuel and vapors into the reservoir when the tank is overfilled. A dual lid arrangement is provided to prevent water and debris from contaminating the fuel in the reservoir.

15 Claims, 10 Drawing Figures

OVERFILL AND SPILLAGE PROTECTION DEVICE

BACKGROUND OF THE INVENTION

This invention relates to underground tanks for storing motor fuel, such as gasoline and diesel fuel, and more particularly, to equipment for containing spillage and overfill of motor fuel from underground storage tanks.

Underground storage tanks are used at service stations to store different blends (octanes) of gasoline and diesel fuel for customer service pumps. Underground tanks are filled from tank trucks and trailers. Tank trucks often have four or more compartments to hold different blends of gasoline and diesel fuel for different underground tanks in the service station.

Leaky fill hoses and defective hose connections between the tank truck and underground tank can cause spillage of motor fuel into the ground. Spillage will also occur if the fill hose is removed from the underground tank before the hose is properly drained.

Another problem is that inattentive drivers often overfill underground gasoline and diesel tanks. Such overfill will typically back up into the fill hose. When the driver disconnects and removes the fill hose, much of this excess motor fuel will spread over the driveway and drain into the ground.

Excess amounts of spillage and overfill of motor fuel might contaminate the soil and pollute groundwater and surrounding areas as well as create a fire hazard.

In recent years, many states, such as Florida and Michigan, have enacted containment laws and regulations to protect the environmental quality of the land and surrounding areas about which these underground storage tanks are located. Such containment laws and regulations generally require operators and owners of underground gasoline and diesel fuel tanks to provide means for containing spillage and/or overfill of the motor fuel.

Over the years, a number of devices have been suggested for containing petroleum and other materials. Typifying these prior art devices are those found in U.S. Pat. Nos. 3,732,902, 4,204,564, and 4,457,349. These prior art devices have met with varying degrees of success.

It is, therefore, desirable to provide an improved device which overcomes most, if not all, of the above problems.

SUMMARY OF THE INVENTION

An environmentally safe protection device and assembly is provided to contain and store both fill hose spillage and underground tank overfill of gasoline, distillate fuels, and other petroleum products. Advantageously, the containment and protection device complies with significant aspects of state environmental containment laws and regulations and is dependable, reliable, safe, and effective. The containment and protection device is also relatively inexpensive to manufacture, easy to install, and readily adaptable for use with existing underground storage tanks.

Structurally, the containment and protection device has a special dual purpose tube assembly to accommodate: (1) filling of petroleum fuel from a fill hose of a tank truck into an underground storage tank and (2) containment of overfill from the underground tank and fill hose. A spillage and overfill containment reservoir is provided to contain spillage from the fill hose and overfill from the tube assembly. A dual purpose one-way check valve is provided to: (1) drain petroleum fuel from the reservoir into the underground storage tank when the underground tank is being substantially emptied or has reached a partially empty state and (2) prevent backfilling of petroleum fuel into the reservoir when the underground tank is overfilled by blocking upward flow of the overfill through the valve.

As commonly used in the petroleum industry and in this application, the term "overfill" refers to petroleum fuel which exceeds the storage capacity of an underground storage tank. Such overfill may overflow an underground storage tank when it has been filled beyond its capacity.

For Stage I (One) Vapor Recovery Units, the tube assembly desirably comprises an internal fill tube and an external vapor return tube. In the preferred form, the internal fill tube is positioned concentrically within the external vapor return tube. The annular space between the internal and external tubes provides a multi-purpose passageway and chamber for return of displaced vapors and gases from the underground tank when the underground tank is being filled as well as for containment of underground tank overfill. The lower portion of the multi-purpose passageway and chamber accommodates drainage of petroleum fuel from the reservoir and valve into the underground tank.

In the preferred form, the overfill and spillage protection assembly has a screen, a safety lid or cap, and an overhead cover to substantially prevent debris from entering the reservoir and tube assembly. Preferably, the reservoir has sloping walls to enhance drainage.

In use, the protection assembly catches and contains petroleum fuel which is spilled, dripped, and leaked from the hose connection and fill hose at the inlet of the underground storage tank. In an overfill situation, the protection assembly contains excess petroleum fuel from the underground tank as well as overfill in the fill hose. Advantageously, the captured petroleum fuel automatically drains back into the underground storage tank through the one-way check valve and multi-purpose chamber when the underground tank is being emptied or has reached an unfull condition.

Water, dirt, and other debris are prevented from entering and contaminating the petroleum fuel in the reservoir and fill tube because of a special dual lid construction and arrangement comprising a primary overhead manhole cover and a secondary, dual purpose, sealed reservoir cap. The dual purpose reservoir cap serves to seal vapors and gases in the containment device and prevents water seepage into the reservoir. The external annular space about the reservoir cap desirably allows water and debris to drain over the exterior sloping surfaces of the reservoir into the ground. The dual lid arrangement can also eliminate the need for conventional fill pipe caps.

The containment and protection device of this invention can be effectively used at almost any service station in an environmentally safe and easy manner to efficiently contain and store spillage and overfill of gasoline and diesel fuel from fill-up of underground storage tanks. Advantageously, the protection device automatically returns virtually all the spillage and overfill to the underground storage tank when the underground tank is emptied or has reached a partially empty state, without manual assistance, labor, and personnel.

The novel containment protection device minimizes product loss and contamination. It results in considerable savings of petroleum fuel, manpower, and clean-up costs.

The containment protection device of this invention is cost-effective, efficient, and environmentally desirable.

A more detailed explanation of the invention is provided in the following description and appended claims taken in conjunction with the accompanying drawings.

DETAILED DESCRIPTION OF THE PREFERRED EMBODIMENTS

Figure 1:
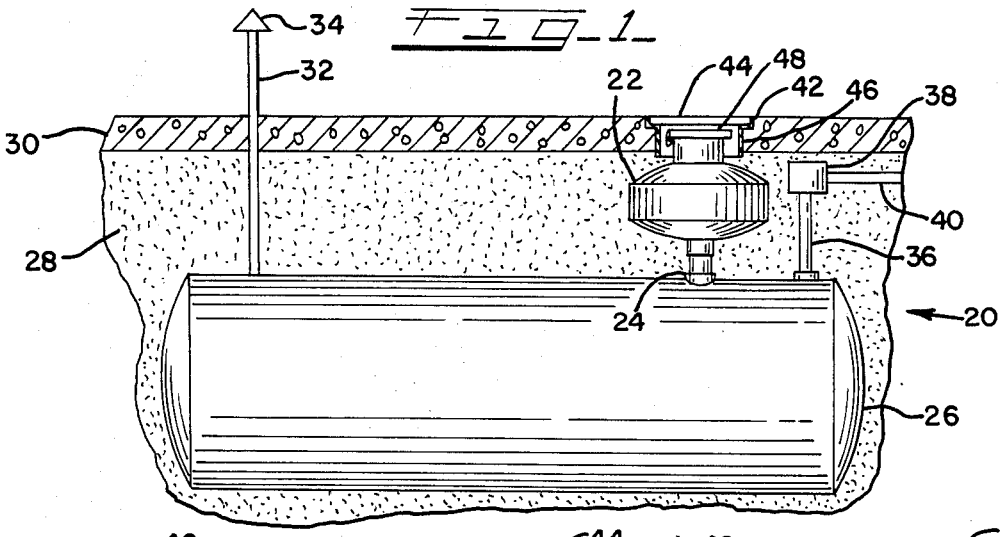
FIG. 1 is a perspective view of an overfill and spillage protection device positioned at the inlet of an underground storage tank in accordance with principles of the present invention.

FIG. 1 typifies an underground storage tank assembly 20 in which an environmentally safe, overfill and spillage containment and protection device and assembly 22 is connected to the inlet 24 of an underground storage tank 26. The underground tank assembly is located substantially below ground level and is surrounded by pea gravel 28 (3/16" to ⅜" size stones, pebbles, or river gravel) or other material to facilitate drainage of water, dirt, and other debris about the exterior surfaces of the tank assembly. When properly installed, the pea gravel allows for drainage as well as normal ground movement due to settling and weather-related conditions such as contraction during freezing weather and expansion during summer. In order to support a gasoline tank truck or trailer, the pea gravel is covered with a reinforced concrete roadway or driveway 30.

The underground storage tank 26 has an upwardly extending vent line or pipe 32 which extends above ground level and the roadway 30 for ten or more feet to vent vapors and gases which are displaced from the tank. A rain cap 34 is secured and seated on top of the vent. An outlet conduit and discharge pipe 36 extends upwardly from a submerged pump in the underground tank for discharge of the motor fuel contained in the tank. The outlet is connected to a pump control housing 38 which in turn is connected to a horizontal or transverse outlet line 40. The horizontal outlet line extends to an above-ground, gasoline or diesel fuel customer service pump, outlet nozzle, spout, or dispenser.

The underground storage tank itself is made out of a rigid, fluid-impervious material, such as mild carbon steel or other metal. Other substantially rigid, fluid-impervious materials, such as fiberglass, can also be used. The metal tank is preferably cathodically protected to minimize external corrosion and/or otherwise incorporates or is coated with a rust inhibitor. The underground tank preferably has a capacity from 2,000 to 16,000 gallons. The illustrated underground tank has a cylindrical configuration and is elongated in the horizontal direction. Underground storage tanks having other shapes can also be used.

In order to have access to the underground storage tank and containment protection device, a manhole cover assembly 42 is securely mounted in the roadway. The manhole cover assembly includes a horizontal manhole cover 44 and a downwardly extending manhole skirt 46. The manhole cover is spaced above and coaxially aligned with the horizontal reservoir cap and lid 48 of the protection device in order to provide primary protective covering for the fill and vapor return tubes and reservoir of the containment protection device. The manhole cover is positioned generally horizontally at ground level at the upper surface of the reinforced concrete roadway. In the illustrative embodiment, the manhole cover is rectangular in shape and made of plate steel. The manhole cover has a sufficient thickness to support the weight of a tank truck and normal driveway traffic. Circular manhole covers or manhole covers having other shapes can also be used.

The manhole skirt 46 (FIG. 2) is annular and made of metal. The manhole skirt extends vertically downwardly from the manhole cover to a location spaced above the upper exterior surface and section 50 of the spillage and overflow containment reservoir 52 and is spaced concentrically outwardly away from the annular metal collar or neck 54 of the containment protection device to provide a drainage passageway and space therebetween for passage of water, dirt, and other debris over the exterior surface of the reservoir into the pea gravel. The exterior annular passageway also accommodates ground movement and shifting of the pea gravel due to settling and shifting of the ground, such as from seasonal changes of weather.

Figure 3:
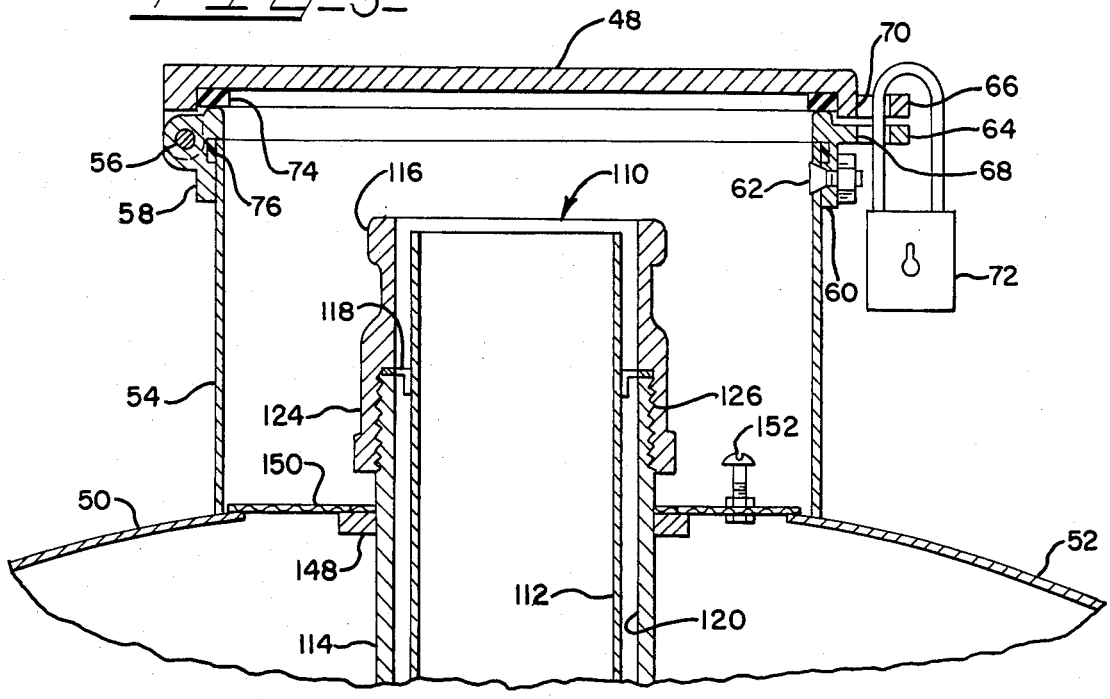
FIG. 3 is an enlarged fragmentary cross-sectional view of the upper portion of the overfill and spillage protection device equipped for Stage I Vapor Recovery.
Figure 5:
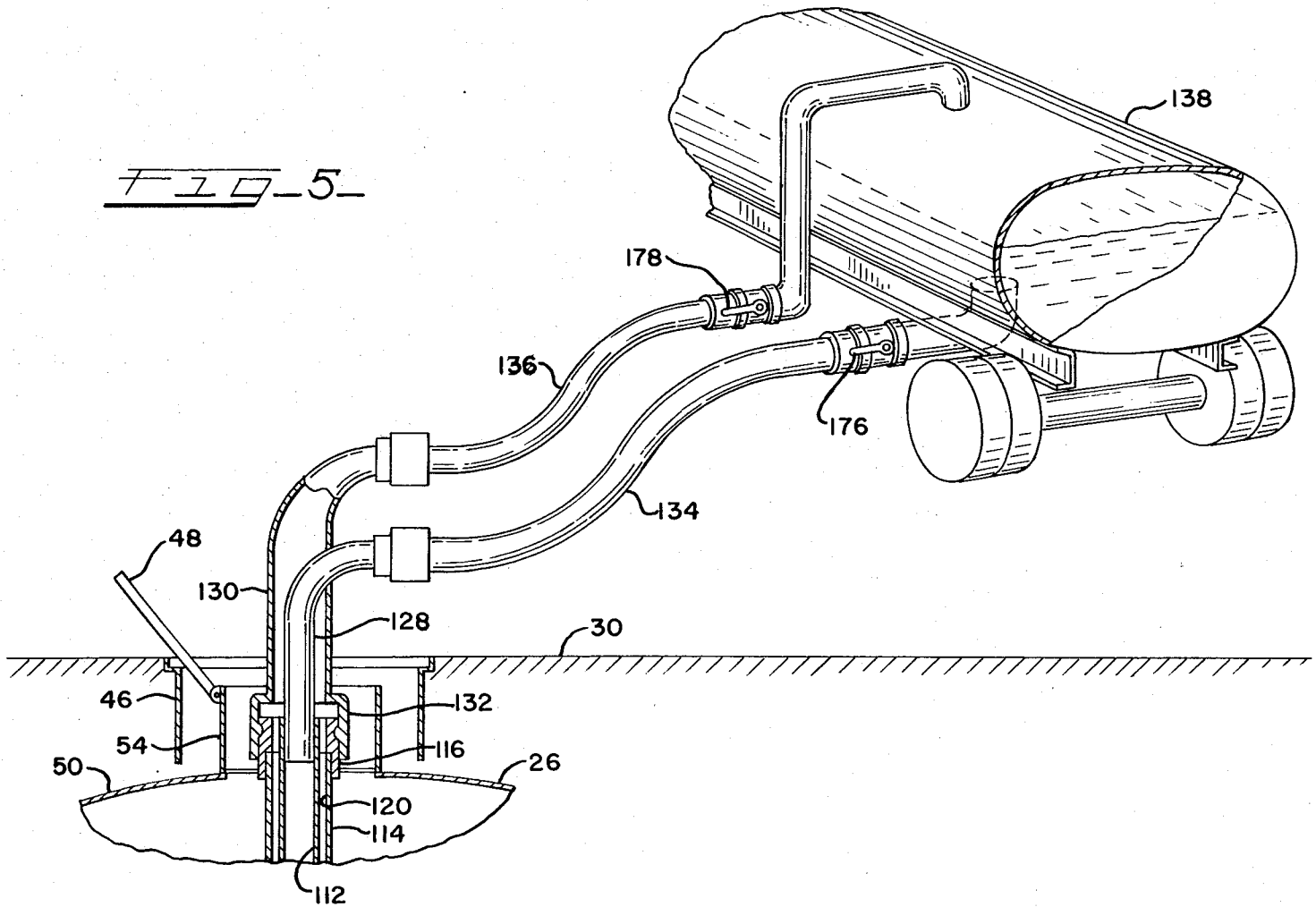
FIG. 5 is a perspective view of a tank truck with its fill hose and vapor return hose connected to the fill tube and vapor return tube, respectively, of the overfill and spillage protection device and showing portions in cross-section.

As best shown in FIG. 3, the collar 54 extends vertically upwardly from the upper convex section 50 of the reservoir to a location adjacent to the reservoir cap 48. The reservoir cap is pivotally connected to the collar by pivot pins 56 of hinge assemblies 58. The hinge assemblies are integrally connected to and part of an annular flange and bracket arm 60. For convenience of use, the flange can be secured to the collar by bolts 62 or other suitable fasteners at a location selected by the gasoline service station manager. The cap pivots from a closed position as shown in FIG. 3 to an open position as shown in FIG. 5 to accommodate filling of the underground storage tank.

The flange and bracket 60 (FIG. 3) has a horizontal C-shaped extension arm and lip 64 which is aligned below an upper C-shaped extension arm and lip 66 that extends outwardly from the reservoir cap. The C-shaped extension arms have aligned holes or slots 68 and 70 to receive an optional padlock 72 or other type of lock. An annular gasket 74 can be placed upon the hinge assemblies and the flange to more effectively seal the reservoir cap in its closed position. The hinge assembly and flange can also have an inner annular groove about the top of the collar to receive an O-ring and seal 76.

Figure 7:
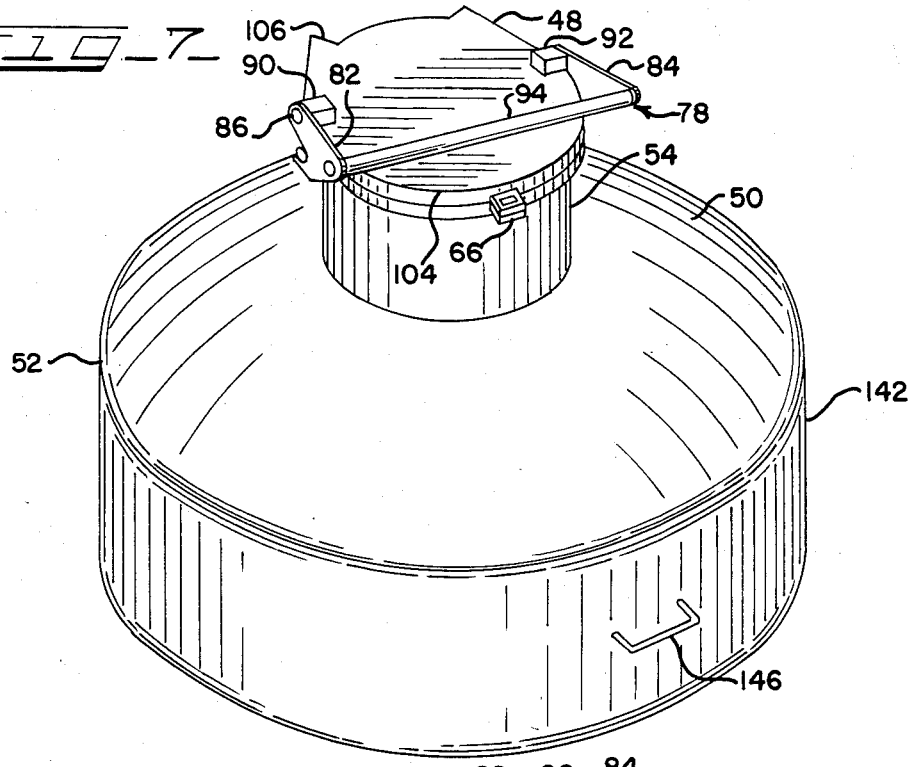
FIG. 7 is a perspective view of an overfill and spillage protection device equipped with a cam lock in accordance with principles of the present invention.
Figure 8:
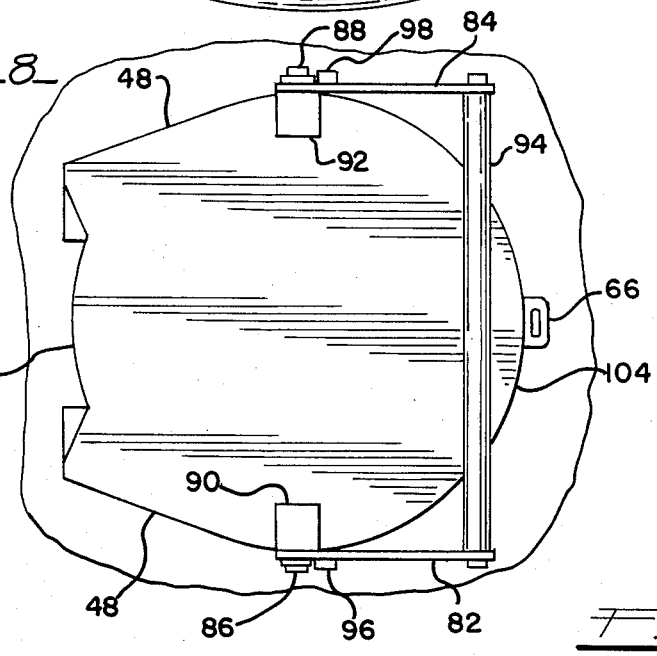
FIG. 8 is a top view of the overfill and spillage protection device of FIG. 7.
Figure 9:
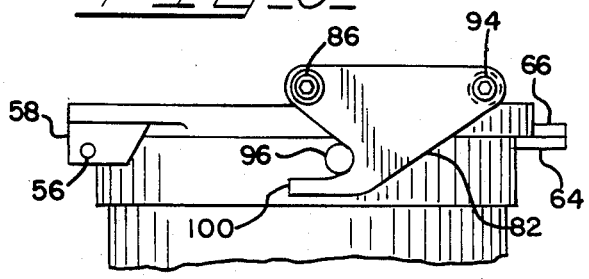
FIG. 9 is a side view of the cam lock in its locked position.
Figure 10:
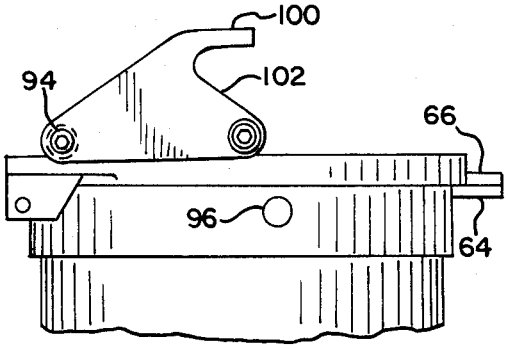
FIG. 10 is a side view of the cam lock in its open position.

In order to further seal the reservoir cap against the flange and upper rim of the collar, the cap can be provided with a cam lock 78 as shown in FIGS. 7–10. The cam lock, which is sometimes referred to as a cam lock assembly, has a pair of cam-locking members 82 and 84 which are pivotally connected to the reservoir cap by pivot pins 86 and 88 of cam hinge assemblies 90 and 92. A manually grippable cylindrical bar 94 extends between and is connected to the locking members to provide a handle for moving the locking members from a closed position against the locking pins 96 and 98 as best shown in FIGS. 7–9 to an open position as shown in FIG. 10.

Each locking member has a triangular body with an elongated tangential cam 100 that extends from the apex portion of the triangular body in a direction away from the handlebar 94. The base of the triangular body portion of each cam lock has one end connected to a pivot pin and another end connected to the handlebar. Each locking member has a U-shaped camming surface 102 that extends along the inward side of the cam and the triangular body portion to cammingly engage the locking pins when the cam lock is moved by the handlebar to its closed position.

The cam lock sealingly locks the reservoir cap against the flange and collar of the containment protection device to prevent rain and debris from entering the reservoir, inlet tube and vapor return tube, as well as to prevent escape of vapors and gases from the protection device. The illustrated cam lock is manufactured by Enterprise Brass Works of Muskegon, Michigan.

As shown in FIGS. 7 and 8, the reservoir cap can have a semicircular front portion 104 and a double-winged, tangential rear portion 106 to accommodate the dual hinge assembly.

Figure 2:
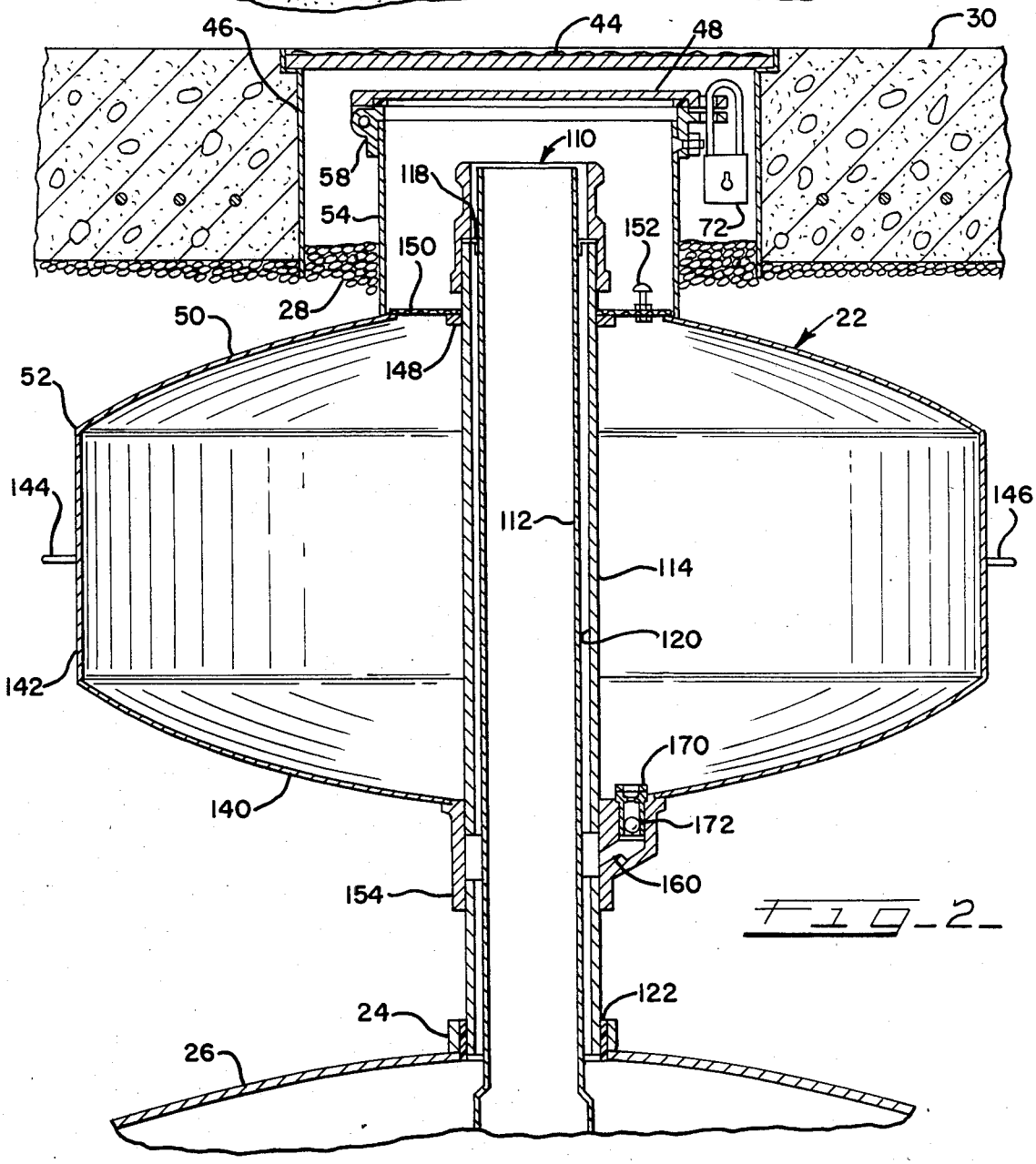
FIG. 2 is a front cross-sectional view of the overfill and spillage protection device.

As shown in FIGS. 2 and 3, the collar 54 is positioned concentrically about and outwardly of the top of a fill tube assembly 110 to provide an annular space and passageway therebetween for passage of overfill from the tube assembly into the reservoir. The top rim of the collar extends above the tube assembly. For Stage I Vapor Recovery Units, the tube assembly comprises an interior upright, rigid fill tube and inlet 112, an exterior rigid, vapor return tube and outlet 114, and a boot adapter and helmet coupling 116. The interior fill tube, which is also referred to as a fill pipe or riser, can be made of rolled 22-gauge aluminum. The interior fill tube extends vertically upwardly from the inlet of the underground storage tank to a position adjacent to the top of the adapter. The bottom of the fill tube extends into the storage tank. The top of the fill tube provides an inlet mouth. The inlet tube serves as a conduit for filling motor fuel, such as gasoline and diesel fuel, into the storage tank from the fill hose of a tank truck.

An annular flange or ears 118 (FIG. 3) is secured against the top of the exterior vapor return tube as well as against the exterior upper portion of the interior fill tube to securely position the exterior tube about the interior tube. The exterior vapor return tube can be a four-inch diameter pipe. In the preferred embodiment, the exterior tube is positioned concentrically about and outwardly from the interior fill tube to provide a multipurpose, annular vapor return space and passageway 120 therebetween for upward flow of vapors, gases, and overfill from the underground storage tank when the underground tank is being filled with motor fuel. The vapor return passageway also provides a chamber for drainage and return of overfill to the underground tank when the tank is emptied.

Figure 4:
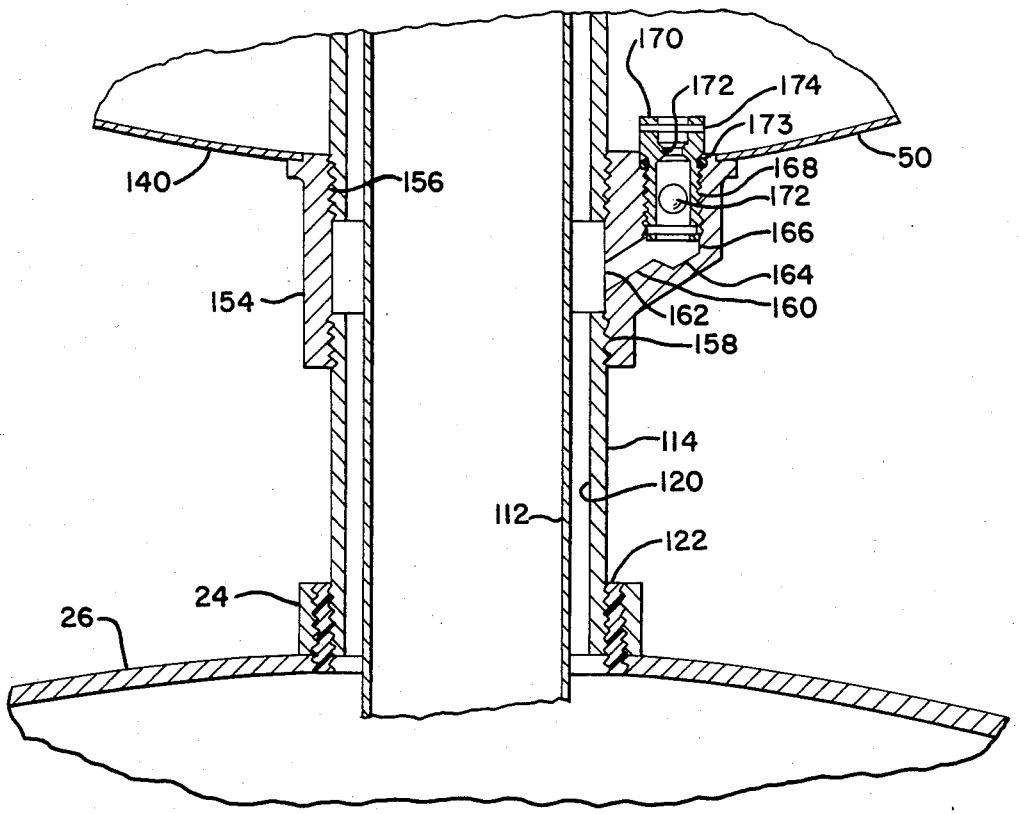
FIG. 4 is an enlarged fragmentary cross-sectional view of the lower portion of the overfill and spillage protection device of FIG. 3.

As shown in FIGS. 2 and 4, the bottom portion of the exterior tube 114, which can be an extension pipe, is secured to the top of the underground storage tank 26 about the tank's inlet or bung 24. A plastic dielectric insulator bushing 122 (FIG. 4), such as a PTFE (polytetrafluoroethylene) or Teflon bushing, is threadedly secured between the bung and the bottom of the exterior tube to prevent electric current from entering the underground storage tank.

The boot adapter and helmet coupling receive the nozzles 128 and 130 (FIG. 5) of the Stage I Vapor Recovery boot and helmet 132, connected to the fill hose 134 and vapor return hose 136 of a tank truck and trailer 138. The inward annular skirt portion 124 (FIG. 3) of the adapter is threadedly engaged and secured to the threaded upper portion 126 of the exterior vapor return tube.

As shown in FIG. 2, the annular spillage and overfill containment reservoir 52 provides a collection basin and vapor containment chamber which is concentrically mounted about the exterior vapor return tube. The reservoir as well as other parts and components of the containment protection device, except for the removable debris screen, is made of a substantially imperforate material, such as steel or other metal, which is impervious and resistant to chemical degradation from motor fuel and hydrocarbons contained within the containment device. In the illustrative embodiment, the reservoir is made of 12 gauge steel and is epoxy-coated. The reservoir has a sufficient volumetric capacity to store and contain overfill from the underground storage tank as well as the spillage and overfill from the fill hose and vapor return hose. In the illustrative embodiment, the reservoir has a 40-gallon capacity. Other size reservoirs can be used.

As shown in FIG. 2, the reservoir has a downwardly sloping, convex, exterior upper section and outer surface 50 and a downwardly sloping, concave, interior lower section and inner surface 140. The angle of inclination of the upper and lower sections ranges from 5 to 45 degrees and preferably from 15 to 30 degrees for best results. The curved upper and lower sections of the reservoir enlarge the containment and storage capacity of the reservoir and facilitate drainage. The curved exterior upper surface of the reservoir facilitates exterior drainage of water, dirt, and other debris along the outer surface of the reservoir into the pea gravel. The curved inner lower section of the reservoir facilitates downward drainage of overfill in the reservoir into the underground storage tank, via the lower portion of the annular vapor return passageway 120, when the underground tank is emptied.

The reservoir has an annular upright wall portion 142 (FIG. 2) which extends vertically between and connects the outer ends of the upper and lower sections. The wall portion is equipped with handles 144 and 146 to facilitate handling and installation.

An annular centering ring and screen support 148 (FIGS. 2 and 3) is secured to the outer surface of the exterior vapor return tube 114, such as by set screws or by welding. The centering ring is positioned at a location generally in alignment with the upper ledge of the reservoir's curved upper section. The centering ring and ledge cooperate with each other to support a removable annular screen and rigid filter 150 to substantially prevent debris from falling into the reservoir and contaminating the motor fuel contained therein. The screen and ledge are spaced at a height below the tops of the exterior vapor return tube and the interior fill tube. The screen filters out dirt, leaves, cigarettes, bugs, snow, ice, and other debris which may fall into the collar passageway, between the collar and tube assembly, when the reservoir cap is opened to fill the underground storage tank. The screen has at least one upwardly extending bolt 152 or other manually grippable member which serves as a handle to remove the screen. It is desirable to periodically remove the screen and clean and remove the debris contained thereon, to maintain the filtering capacity of the screen.

An annular, reservoir-mounting support and valve casting 154 (FIGS. 2 and 4) supports the reservoir above the underground storage tank. The casting has a threaded inner annular surface 156 which threadedly engages and is securely attached to an exterior threaded portion 158 of the bottom portion of the exterior vapor return tube. The valve casting has a flow passageway and fuel drain 160 (FIG. 4) which extends into and communicates with a drain hole or opening 162 in the lower portion of the exterior vapor return tube. The fuel drain slopes at a downward angle of inclination into the drain hole. The upper end of the fuel drain has a downwardly extending conical trap and sump 164 which communicates with an upright valve-receiving opening 166. The interior surface of the valve-receiving opening is threaded to removably receive and threadedly engage the exterior threaded surface 168 of a one-way check valve 170.

In the preferred embodiment, the check valve comprises a float valve having a ball float 172 (FIG. 4) with a specific gravity and density substantially less (lighter) than the motor fuel. The ball float can be made of aluminum. Ball floats made of plastic or other types of metal can also be used. The float valve has a reduced diameter orifice and neck 172 against which the ball floats and is sealed when excess motor fuel and overfill enters the bottom of the float valve. The float valve also has an O-ring or valve ring 173 adjacent the upper end of the threaded surface to fluidly seal the valve in the casting. The upper portion of the float valve is equipped with a horizontal transverse access pin 174 which is adapted to cooperate with and receive a hooked tool or other instrument that is lowered into the reservoir, after the screen has been removed, to periodically remove and replace the valve.

The one-way valve is operatively connected to and communicates with the lower section of the reservoir and the drain to permit passage of overfill and spillage from the reservoir into the drain and then to the lower portion of the annular vapor return passageway 120 into the underground storage tank when a substantial portion of the motor fuel in the underground tank is withdrawn through the tank's outlet. The check valve blocks upward flow of overfill from the underground tank through the valve in an overfill situation. The ball float also seals against the neck at an upward vapor pressure of about 0.1 psig to seal and close the valve in order to block the upward return of vapors and gases into the reservoir.

As shown in FIG. 5, in operation, in order to fill the underground storage tank, the manhole cover is removed and the reservoir cap opened. The Stage I Vapor Recovery helmet and boot from the tank truck is connected to the adapter so that the nozzle of the fill hose extends into the mouth of the fill tube and the nozzle of the vapor return hose communicates with the vapor return passageway adjacent to the exterior vapor return tube. The valves 176 and 178 of the fill hose and vapor return hose are then opened to drain the desired motor fuel out of the tank truck into the underground storage tank via the interior fill tube. The tank truck is emptied and drained by gravity, such as at a flow rate of 300 gpm. As the underground tank is being filled, the displaced vapors and gases in the underground tank flow upwardly and return to the tank truck via the vapor return passageway and the vapor return hose.

If the driver or operator fills the underground storage tank beyond its capacity, the overfill will move upwardly in the annular vapor return passageway. The overfill will float the ball float against the reduced diameter neck of the float valve to close the valve and prevent upward flow of overfill through the drain and valve into the reservoir. The annular vapor return passageway can store and contain the overfill until the vapor return passageway's capacity is exceeded, at which time the overfill will flow upward into the vapor return hose until the overfill reaches a height and pressure head at equilibrium with the motor fuel in the tank truck. Equilibrium conditions stop the flow of motor fuel from the tank truck even if the operator has not yet closed the valve associated with the fill hose.

When the fill hose valve is closed and the Stage I Vapor Recovery helmet or boot is removed, the overfill in the vapor return hose, as well as in the fill hose, will spill into the reservoir via the screen and the annular collar passageway between the collar and the tube assembly. Spillage from leaky hose connections and defective hose components will also drain into the reservoir via the screen and annular collar passageway.

After the underground tank is filled, the reservoir cap is closed and the manhole cover replaced to its closed position. The overfill in the annular vapor return passageway will automatically return and drain into the underground storage tank when the motor fuel stored in the underground tank is later dispensed and/or emptied through the tank's outlet to the customer service pump or nozzle. Concurrently, the overfill and spillage in the reservoir will automatically return and drain through the one-way check valve into the underground tank via the drain and the lower portion of the annular vapor return passageway.

Within the past six months, about 250 containment protection devices of the type shown in FIG. 2 have been built and successfully tested in service stations of Amoco Oil Company.

Figure 6:
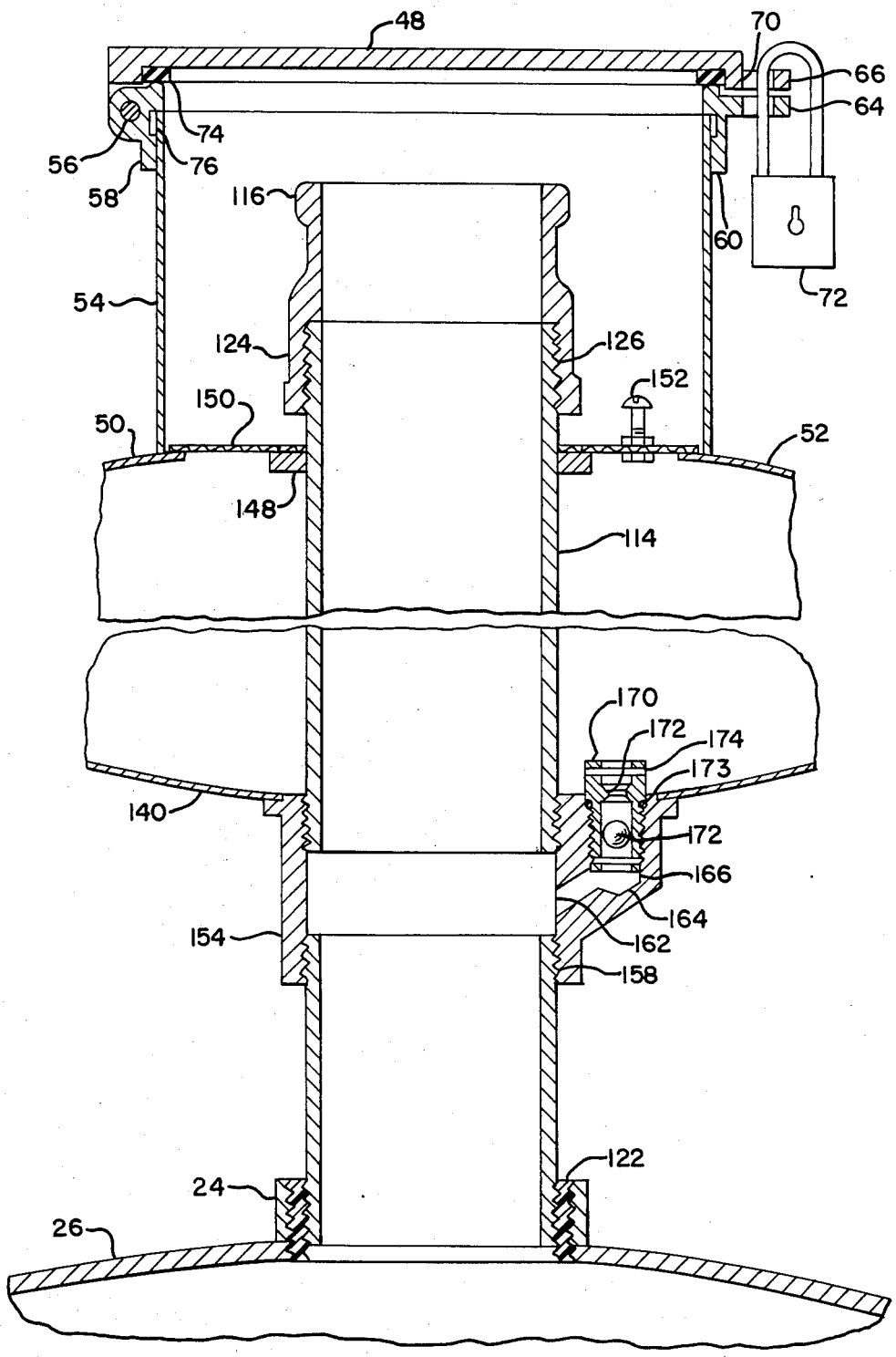
FIG. 6 is a fragmentary cross-sectional front view of another overfill and spillage protection device in accordance with principles of the present invention.

The overfill and spillage containment and protection device shown in FIG. 6 is similar to that shown in FIG. 2 except that it is not equipped with an interior fill tube and separate vapor return passageway to accommodate Stage I Vapor Recovery. In those areas of the country which do not require Stage I Vapor Recovery and in which the available tank trucks are not equipped for Stage I Vapor Recovery, such a unit and protection device can be effectively used. The containment and protection device shown in FIG. 6 is also useful with a 2-point Stage I Vapor Recovery System.

In the containment protection device of FIG. 6, the exterior upright tube 114 provides a fill tube for filling motor fuel, such as gasoline or diesel fuel, from the fill hose of a tank truck into the underground storage tank. The tube also provides a storage and containment chamber to store and contain overfill from the underground tank. In use, motor fuel is drained from the tank truck through the fill hose into the storage tank via the fill tube 114. If the driver or operator overfills the storage tank, the overfill will flow upwardly into the fill tube until its capacity is reached and thereupon backup into the fill hose. The one-way check valve will prevent the overfill from passing upwardly through the valve into the reservoir. Excess motor fuel and overflow from the storage tank moves upwardly through the vent 32 (FIG. 1) until it reaches a height and pressure head at equilibrium with the motor fuel in the tank truck, at which time drainage of the motor fuel from the tank truck will stop even if the operator has not yet closed the valve associated with the fill hose. There is no separate vapor return hose when the tank truck is not equipped for Stage I Vapor Recovery. When the fill hose is removed, excess motor fuel and overfill in the fill hose will drain through the screen and collar passageway into the reservoir. Spillage from leaky hose connections and defective fill hoses will also drain through the screen and collar passageway into the reservoir. As motor fuel is withdrawn through the outlet of the underground storage tank and dispensed to the service pump and nozzle, overfill in the vent line and in the fill tube are automatically returned and drained back into the storage tank. Concurrently, overfill and spillage in the reservoir is automatically returned and drained through the valve and fuel drain into the underground storage tank via the lower portion of the fill tube.

The containment protection devices of this invention are particularly advantageous because they contain and control both spillage and overfill in an environmentally safe, efficient, and effective manner. The containment protection device is relatively inexpensive to manufacture, easy to install, and readily adaptable for use with existing underground storage tanks.

The overfill and spillage protection device is particularly useful for containing and storing motor fuel in gasoline service stations for use with cars, trucks, and other motor vehicles. The overfill and spillage protection device can also be effectively used for containing and storing heating oil, airplane and jet fuel, and other petroleum fuels and products in underground storage tanks at airports, farms, homes, and other locations. The overfill and spillage protection device can further be effectively used to contain and store petrochemicals and other materials which may be stored in underground storage tanks.

Although embodiments of this invention have been shown and described, it is to be understood that various modifications and substitutions, as well as rearrangements and combinations of parts, equipment, and/or components, can be made by those skilled in the art without departing from the novel spirit and scope of this invention.

What is claimed is:

1. An overfill and spillage protection device, comprising:

tube means for filling a petroleum fuel into an underground storage tank from a fill hose of a tank truck and for receiving overfill of said petroleum fuel from said underground storage tank;

reservoir means positioned above said underground storage tank for receiving spillage from said fill hose and overfill from said tube means;

screen means mounted annularly and externally about said tube means for substantially preventing debris from entering said reservoir means; and valve means for accommodating drainage of said petroleum fuel from said reservoir into said underground storage tank when said underground storage tank is being substantially emptied and for substantially preventing backfilling of said petroleum fuel into said reservoir when said underground tank is overfilled.

2. An overfill and spillage protection device in accordance with claim 1 wherein said tube means comprises substantially concentric tubes positioned radially inwardly of said valve means, said concentric tubes including an internal fill tube and an external vapor return tube annularly surrounding said internal fill tube, said internal fill tube cooperating with said external vapor return tube to define an annular overfill chamber therebetween for receiving said overfill, and said overfill chamber communicating with said valve means for accommodating said drainage of petroleum fuel into said underground storage tank.

3. An overfill and spillage protection device in accordance with claim 1 wherein said reservoir means has sloping walls for enhancing drainage.

4. An overfill and spillage protection assembly, comprising:

an underground storage tank for storing a motor fuel selected from the group consisting of gasoline and diesel fuel, said underground storage tank having an outlet and a generally upwardly facing inlet;

an upright fill tube connected to and extending generally upwardly from said inlet of said underground storage tank for filling said motor fuel from a fill hose of a tank truck into said underground storage tank and for containing at least a portion of any overfill from said underground tank, said fill tube having a bottom portion and a top;

an annular reservoir concentrically mounted about said fill tube at a location spaced above said underground storage tank and below the top of said fill tube for containing spillage from said fill hose and overfill from said fill tube, said reservoir defining a lower section and an upper section with an exterior surface and having a capacity greater than the volumetric capacity of said fill hose;

a drain connected to the bottom portion of said fill tube below said reservoir;

a one-way valve operatively connected to and communicating with the lower section of said reservoir for permitting passage of motor fuel in said reservoir into said drain for passage through the bottom portion of said fill tube into said underground storage tank when a substantial portion of the motor fuel in said tank is withdrawn through said outlet and for substantially blocking upward flow of overfill from said tank through said valve;

a removable annular screen concentrically positioned about said fill tube and upon the upper section of said reservoir for substantially preventing debris from falling into said reservoir, said debris including at least one member selected from the group consisting of dirt, leaves, cigarettes, bugs, snow, ice, and fragments thereof;

a collar extending generally upwardly from the upper section of said reservoir, said collar being concentrically positioned about the top of said fill tube to define an annular passageway therebetween for passage of overfill from said fill tube into said reservoir and having an upper portion spaced above the top of said fill tube;

a cap for engaging the upper portion of said collar to provide secondary protective covering for said fill tube and said reservoir;

a manhole cover spaced above said cap to provide primary protective covering for said fill tube and said reservoir; and a manhole skirt extending downwardly from said manhole cover to a location above said reservoir and being spaced about said collar to define a drainage passageway therebetween for passage of water and debris over the exterior surface of said reservoir.

5. An overfill and spillage protection assembly in accordance with claim 4 wherein said reservoir has a downwardly sloping convex upper section and a concave lower section.

6. An overfill and spillage protection assembly in accordance with claim 4 wherein said valve comprises a float valve having a ball float with a density substantially less than said motor fuel.

7. An overfill and spillage protection assembly in accordance with claim 4 wherein said cap includes a cam lock for cammingly locking and sealingly engaging said cap against the top portion of said collar.

8. An overfill and spillage protection assembly in accordance with claim 4 wherein said cap and collar have aligned, generally C-shaped extension lips for receiving a padlock and said cap includes hinge means for hingably connecting said cap to said collar at locations generally opposite said extension lips.

9. An overfill and spillage protection assembly, comprising:

an underground storage tank for storing a motor fuel selected from the group consisting of gasoline and diesel fuel, said underground storage tank having an outlet and a generally upwardly facing inlet;

an interior upright fill tube connected to and extending generally upwardly from said inlet of said underground storage tank for filling said motor fuel from a fill hose of a tank truck into said underground storage tank, said fill tube having a bottom extending into said storage tank and a top defining an inlet mouth;

an exterior vapor return tube mounted concentrically about and positioned outwardly from said interior fill tube to define an annular chamber therebetween for upward flow of vapors and overfill of motor fuel from said underground storage tank, said exterior vapor return tube having a bottom portion secured to said storage tank and a top for receiving an adapter for releasable connection to a vapor return hose;

an annular reservoir providing a collection basin concentrically mounted about said exterior vapor return tube at a location spaced above said underground storage tank and below the tops of said tubes for containing spillage from said fill hose and overfill from said interior vapor return tube, said reservoir defining a lower section and an upper section with an exterior surface and having a volumetric capacity greater than the volumetric capacity of said vapor return hose;

a drain connected to the bottom portion of said exterior vapor return tube below said reservoir;

a one-way valve operatively connected to and communicating with the lower section of said reservoir and said drain for permitting passage of motor fuel in said reservoir into said drain for passage through the annular chamber about the bottom portion of said exterior vapor return tube into said underground storage tank when a substantial portion of the motor fuel in said tank is withdrawn through said outlet and for substantially blocking upward flow of overfill in said annular chamber from said underground storage tank through said valve;

a removable annular screen concentrically positioned about said exterior vapor return tube and upon the upper section of said reservoir for substantially preventing debris from falling into said reservoir, said debris comprising at least one member selected from the group consisting of dirt, leaves, cigarettes, bugs, snow, ice, and fragments thereof;

a collar extending generally upwardly from the upper section of said reservoir, said collar being concentrically positioned about the top of said exterior vapor return tube to define an annular passageway therebetween for passage of overfill from the top of said exterior vapor return tube into said reservoir and having an upper portion spaced above the top of said exterior vapor return tube;

a cap for engaging the upper portion of said collar to provide secondary protective covering for said tubes and said reservoir;

a manhole cover spaced above said cap to provide primary protective covering for said tubes and said reservoir; and a manhole skirt extending downwardly from said manhole cover to a location above said reservoir and being spaced about said collar to define a drainage passageway therebetween for passage of water and debris over the exterior, surface of said reservoir.

10. An overfill and spillage protection assembly in accordance with claim 9 wherein said reservoir has a downwardly sloping, convex upper section and a downwardly sloping, concave lower section.

11. An overfill and spillage protection assembly in accordance with claim 9 wherein said cap includes a cam lock for cammingly locking and sealingly engaging said cap against the top portion of said collar.

12. An overfill and spillage protection assembly in accordance with claim 9 said cap and collar have aligned, generally C-shaped extension lips for receiving a padlock and said cap includes hinge means for hingably connecting said cap to said collar at locations generally opposite said extension lips.

13. An overfill and spillage protection assembly in accordance with claim 9 wherein said screen has a manually grippable handle to accommodate removal of said screen.

14. An overfill and spillage protection assembly in accordance with claim 9 wherein said valve comprises a float valve having a ball float with a specific gravity substantially less than said motor fuel.

15. An overfill and spillage protection assembly in accordance with claim 14 wherein said float valve includes means to accommodate removal and replacement of said valve.

* * * * *

UNITED STATES PATENT OFFICE
CERTIFICATE OF CORRECTION

Patent No. 4,615,362 Dated October 7, 1986

Inventor(s) HARRY B. HARTMAN - GERALD V. LALONDE - MICHAEL S. BUTKOVICH - IRWIN GINSBURGH - DENNIS J. STROCK

It is certified that error appears in the above-identified patent and that said Letters Patent are hereby corrected as shown below:

On the Title Page

Page 1 Item 75 "Harry B. Hartman, Sugar Grove, IL
Gerald V. LaLonde, Durham, N.C.
Michael S. Butkovich, Aurora, IL"
should be --
Harry B. Hartman, Sugar Grove, IL
Gerald V. LaLonde, Durham, N.C.
Michael S. Butkovich, Aurora, IL
Irwin Ginsburgh, Newhall, CA
Dennis J. Strock, Woodridge, IL --

Signed and Sealed this

Ninth Day of August, 1988

*Attest:*

DONALD J. QUIGG

*Attesting Officer*

*Commissioner of Patents and Trademarks*